United States Patent [19]

Conklin, Jr.

[11] Patent Number: 4,920,847

[45] Date of Patent: May 1, 1990

[54] TUNING PIN FOR PIANOS

[76] Inventor: Harold A. Conklin, Jr., P.O. Box 1915, Dunedin, Fla. 34697

[21] Appl. No.: 325,870

[22] Filed: Mar. 20, 1989

[51] Int. Cl.[5] ..... G10C 3/10

[52] U.S. Cl. ..... 84/202

[58] Field of Search ..... 84/200, 201, 202, 304, 84/305

[56] References Cited

U.S. PATENT DOCUMENTS

| | | | |
|---|---|---|---|
| 375,150 | 12/1887 | Goodenow | 84/202 |
| 388,720 | 8/1888 | Richardson | 84/214 |
| 420,914 | 2/1890 | Muller | 84/202 |
| 488,843 | 12/1892 | Smith | 84/202 |
| 1,094,653 | 4/1914 | Hillcoat | 84/203 |
| 1,339,418 | 5/1920 | Poehland | 84/305 |
| 1,384,459 | 7/1921 | Grover | 84/305 |
| 1,443,486 | 1/1923 | Lindstrom | 84/305 |
| 1,615,228 | 1/1927 | Marthy | 84/202 |
| 2,736,224 | 2/1956 | Trinkle | 84/202 |
| 3,091,149 | 5/1963 | Walsh | 84/201 |
| 3,156,151 | 11/1964 | Andersen | 84/201 |
| 3,721,147 | 3/1973 | Okugawa | 84/186.1 |
| 3,757,026 | 9/1973 | Carbone | 84/202 |
| 3,805,666 | 4/1974 | Okugawa | 84/186.1 |

FOREIGN PATENT DOCUMENTS

| | | | |
|---|---|---|---|
| 227526 | 1/1910 | Fed. Rep. of Germany | 84/202 |
| 340968 | 11/1921 | Fed. Rep. of Germany | 84/201 |
| 381384 | 9/1923 | Fed. Rep. of Germany | 84/201 |
| 444828 | 1/1927 | Fed. Rep. of Germany | 84/202 |
| 4279523 | 10/1981 | France | 84/202 |
| 21136 | of 1900 | United Kingdom | 84/202 |
| 301607 | 12/1928 | United Kingdom | 84/202 |

*Primary Examiner*—Michael L. Gellner
*Assistant Examiner*—Brian W. Brown

[57] ABSTRACT

Tuning pins that provide adjustable torque, mount directly onto the string plate of a piano, and require no wrest plank. The pins have threaded cores that resemble conventional tuning pins except for coarser threads, and have coaxial collars intermediate their length. Torque is adjusted with a locknut that is also used to mount the pin. Torque is developed by lubricated friction interfaces. Each lubricated friction interface comprises a stationary friction element, a friction element that turns with the pin, and a film of lubricant material between the two. The lubricant material may be hydrodynamic fluid or solid. One or more compliance elements, assembled onto the core, provide compensation for wear and vernier adjustment of torque. In the preferred embodiments the compliance elements are Belleville type spring washers that also act as friction elements. Cores can be made with integral collars, or the collars can be separate parts that are secured to the core. Cores can be made by re-threading conventional tuning pins.

16 Claims, 10 Drawing Sheets

TUNING PIN FOR PIANOS

BACKGROUND OF THE INVENTION

The invention is a tuning pin for direct mounting on the string plates of mechano-acoustic pianos. Present-day pianos employ the same means for tensioning the strings that was used in the oldest known piano, an instrument built by Bartolomeo Cristofori in 1720; Metal pins, each a few centimeters in length and less than one centimeter in diameter, are driven into a slab of wood called a wrest plank or pin block. Each piano string is coiled around a pin in such a way that the tension of the string can be adjusted by rotating the pin about its central axis with a suitable tool. Advantages of this apparently anachronistic method are its simplicity and the low cost of the pins themselves, characteristics that may account for continued use in spite of many disadvantages, mostly relating to the use of a wooden pin block. The present invention seeks to eliminate the disadvantages by eliminating the pin block and by introducing certain novel and useful improvements. The advantages of the invention can best be understood if the problems associated with the use of conventional tuning pins in high quality grand pianos are first outlined.

Convention tuning pins for pianos are about 2.5" (6.35 cm), long are made of steel, and are generally cylindrical in form, but have flats about 0.63" (1.6 cm) long of tapering width on four sides near the upper end to permit engagement with a standard tuning lever, which has a socket tapered to fit the flats. A transverse hold about 0.06" (1.5 mm) in diameter is located at the lower end of the flattened portion to permit insertion of the end of a piano string. The lower part of the pin is threaded for about 1.5" (3.8 cm) of its length with shallow external screw threads of a type not common to any other product. Conventional tuning pins are available in the U.S. in the following standard diameters: 0.282" (7.16 mm), 0.286" (7.26 mm), 0.291" (7.39 mm), 0.296" (7.52 mm), 0.301" (7.64 mm), 0.306" (7.77 mm). Pins of 0.282" (716 mm) diameter normally are used in new pianos. The larger sizes listed are used for periodic replacement as smaller pins become loose.

High quality pin blocks are normally about 1⅜" (3.5 cm) thick and usually are made of a number of relatively thin laminations of selected hardwood that are glued together face to face with a high-quality adhesive. The material and processing of the pin block are crucial to the tunability and longevity of a piano. U.S. Pat. Nos. 2,736,224, 3,091,149, 3,721,147, and 3,805,666 summarize the present art of manufacture of wooden pin blocks.

Pin blocks shaped approximately for the piano models in which they will be used are cut from large slabs of laminate. Each pin block is then hand fitted to a particular metal string plate by filing off small amounts of wood until the contour of the block is complementary to the contour of a mating flange on the string plate. This is done to prevent relative motion between the block and the plate, which could cause unstable pitch in the finished instrument.

After a pin block has been assembled to its plate, the tuning pin holes are located by center-punching through holes that are already in the plate. A precisely sized drill bit must be used, and close control of both rotational and axial bit speed is needed in order to produce cleanly-drilled holes of exactly optimum diameter.

U.S. Pat. No. 2,736,224 teaches the importance of correct procedure. Errors in drilling can cause the pins to be too loose or too tight, the life of the pin block to be shortened, and tunability to be poor. Installing the pins is also a critical operation. If a pin is started with its axis at an angle to the axis of the hole, the hole can become enlarged, causing a loose pin. Abnormally loose or tight pins also can be caused by incorrect pin diameter. The normal diametral tolerance for tuning pins is ±0.001" (±0.025 mm), but pins are sometimes out-of-tolerance or out-of-round. Pins of irregular size produce non-uniform torque.

Dirt, oil, or other foreign matter may enter the pin holes along with the pins, and can cause irregular torque or "stick-slip", a ratchet-like motion of the pin that occurs if the torque required to initiate pin motion is significantly higher than that needed to sustain the motion. Irregular torque or excessive stick-slip can prevent accurate tuning. Irregularities in the wood itself can cause uneven torque. Wide variations of torque from pin to pin frustrate good tuning results. Wooden pin blocks wear out. Because of wear due to tuning and/or deterioration due to an unfavorable storage environment, pin torques gradually decline and eventually may become so low that the piano either cannot be tuned or will not stay in tune. The useful life of a piano is often limited by the life of its pin block.

Piano tuners generally prefer pin torque to be in the range between 75–125 inch-lb (8.48–14.1 Newton-meters). However, if a pin block is drilled to give torque values this low in a new piano, the pins may become too loose to hold tuning long before the normal life span of the instrument has been reached. Therefore, manufacturers normally make the initial torque of the pins higher than is optimum for tuning. Torque cannot be adjusted once the pins have been installed. There are no acceptable effective ways to increase pin torque except by removing the strings and pins and installing oversize tuning pins, or by replacing the entire pin block. Such operations are costly and disruptive to the stability of the instrument. In order to prevent loose pins, some manufacturers make the pins extremely tight when the piano is new. This practice can produce pin torques of 200–300 inch-lb (22.6–33.9 N-m), and pianos that remain difficult to tune accurately for many years after they leave the factory.

That piano technologists have long been aware of the disadvantages outlined above is indicated by the number of patents relating to tuning means for pianos that have been directed toward eliminating the pin block. The following may be cited: U.S. Pat. Nos. 375,150, 388,720, 420,914, 488,843, 1,094,653, 1,615,228, 3,156,151, 3,757,026; German Pat. Nos. 227,526, 340,968, 381,384, 444,828; British Pat. Nos. 21,136, 301,607; French Pat. No. 2,479,523. Despite all previous attempts to displace it, the simple tuning pin and wooden pin block combination still is the only tensioning means for piano strings that is in production use at the present date, so far as is known to the applicant. Further, the only means known to applicant ever to have achieved significant production use in pianos was disclosed by U.S. Pat. No. 388,720, issued to J. P. Richardson on Aug. 28, 1988. This means was used for a time by one piano company but was abandoned, perhaps because accurate tuning was more difficult, excessive space in the piano was required, stringing was difficult, or cost excessive.

SUMMARY OF THE INVENTION

The invention is a tuning pin for mechano-acoustic pianos that mounts directly into holes in the string plate of the piano. Tuning pin torque can be adjusted over a wide range either before or after the strings are installed. Primary objects of the invention are to improve the ease and accuracy of tuning and to extend the life of the instrument. Secondary objects are to simplify the assembly of pianos and reduce the cost of manufacturing by eliminating the wooden pin block and all the manufacturing steps associated with it. Tuning accuracy is improved because the motion of the pins during tuning is very smooth due to the use of lubricated friction interfaces. Tuning ease and speed are improved because pin torque can be set initially to a moderate value that is optimum for tuning without risk that the pins may become irreversibly loose. The adjustable torque feature makes it possible for all the pins in a piano to have the same tuning torque regardless of variations in string tension across the scale, which further facilitates tuning. The pin comprises a core that is similar to a conventional tuning pin except for the use of different threads, and a collar that is coaxial with the core. Pins are assembled to the plate with a locknut. One or more compliance elements, preferably Belleville type spring washers, which can also be used as friction elements, function to compensate for wear of the parts so that a nearly constant value of pin torque can be maintained without adjustment through many tunings. A lubricant, which may be either a hydrodynamic lubricant such as grease or a solid type, is applied within the friction interfaces. Due to the elimination of the wooden pin block, the tuning pin is immune to normal environmental changes.

DETAILED DESCRIPTION OF THE INVENTION

Figure 1:
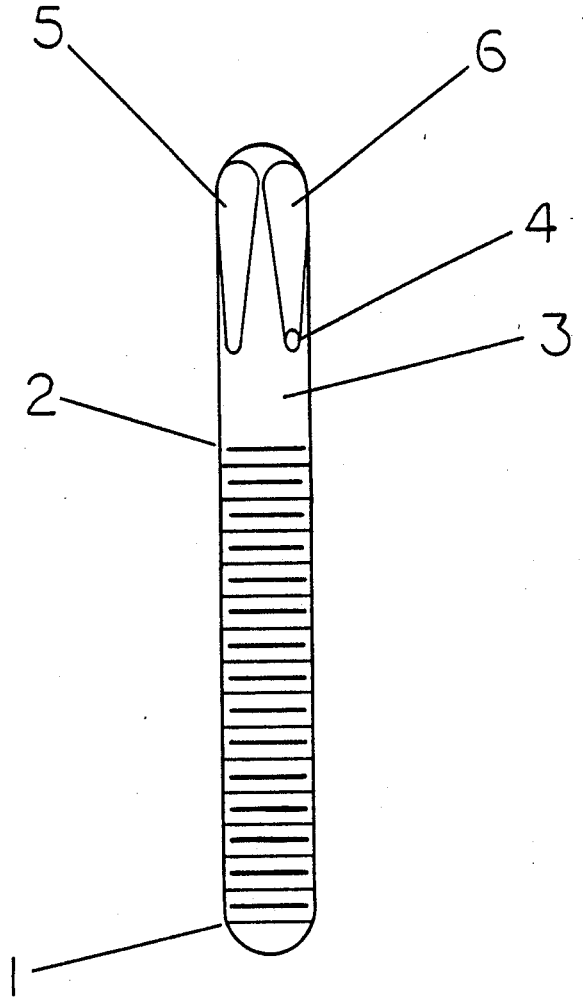
FIG. 1 is a side elevation view of a part of the invention called the core.

The invention will be described in relation to grand pianos. FIG. 1 shows a part of the invention that will be called the core. In order to minimize manufacturing cost and to allow the use of a standard tool for tuning, the core has been given the shape and outer dimensions of a conventional tuning pin of 0.301" (7.645 mm) diameter, which is known in the piano trade as a 6/0 tuning pin. The core is generally cylindrical and of length several times its diameter, and comprises a threaded portion and an unthreaded portion. The threaded portion comprises external screw threads beginning near one end of the core, as indicated by reference numeral 1 in FIG. 1, and ending intermediate the length of the core at reference numeral 2. The core differs from a conventional 6/0 pin only in its threads. Whereas conventional tuning pins have very shallow, non-standard, multiple-start threads, the threads of the core, to be described more fully later, are similar to UNC 5/16-18 threads per ANSI/ASME Standard B1.1. The unthreaded portion of the core comprises a plain portion 3 around which a piano string can be coiled, and a transverse hole 4 for attaching the end of the piano string, and conventional tapered flats spaced 90 degrees apart, two of which are indicated at 5 and 6, for engaging a standard tuning tool. It should be understood that neither the use of 5/16-18 core threads, nor the use of cores of 0.301" diameter, nor the use of conventional tapered flats for engaging a tuning tool as shown by FIG. 1, are essential to the invention. However, use of the above described configuration provides the following three additional practical advantages: (1) Cores can be made with existing equipment for manufacturing tuning pins. (2) Core threads can be formed, if desired, by re-threading conventional tuning pins with an adjustable 5/16-18 threading die. (3) The choice of 6/0 (0.301") (7.645 mm) core diameter, as opposed to say 2/0 (0.282") (7.162 mm) core diameter, allows the use of standard UNC 5/16-18 hex nuts for torque adjustment and for mounting the pin.

Figure 2:
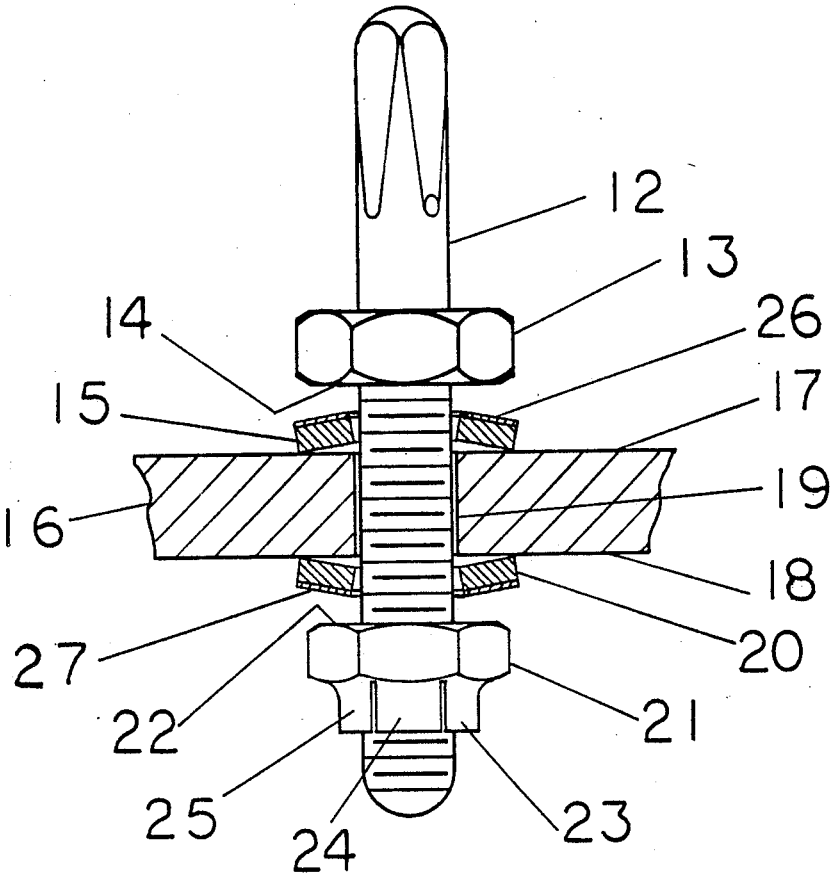
FIGS. 2 through 6 are side elevation views of various embodiments of the invention, with some parts shown in cross section.

FIG. 2 shows a first embodiment of the invention that is also a preferred embodiment. A collar, coaxial with the core 12 and positioned on the core, is shown at 13. The collar has a substantially flat bearing surface 14 that is larger diametrally than the core and that extends in a direction at substantially 90 degrees to the central axis of the core. The collar shown by FIG. 2 is formed separately from the core and is actually a hex nut having internal threads complementary to the external threads of the core. The collar is shown screwed fully onto the core and is secured in place by any of several means to be described so that it will function as an integral part of the core during tuning. The bearing surface of a hex nut that is chamfered as indicated by FIG. 2 normally has the shape of an annular ring. As will be explained later, the collar may alternatively be formed as an integral part of the core.

FIG. 2 shows the tuning pin mounted loosely on the tuning pin panel of a piano string plate, indicated in cross section at 16. In FIG. 2 the elements are shown slightly separated for clarity and it should be understood that the parts of an operational tuning pin will be compressed tightly together. In a grand piano the tuning pin panel, henceforth "the panel", normally lies in a horizontal plane and the only readily visible surface of the panel may be described accurately as the "upper" surface. The points of connection of the strings to the tuning pins normally lie above the upper surface of the panel. In describing the invention the terms "upper" and "lower" will be used to describe the locations of the parts in the orientation of a grand piano. The panel shown by FIG. 2 is conventionally configured, having a substantially flat upper surface 17 and a lower surface 18 that is substantially parallel with the upper surface. The panel is normally an integral part of the string plate, which is usually made of gray cast iron but may be made of steel or other materials at the option of the piano designer. Holes for the tuning pins will have been drilled through the panel at the correct locations on the panel prior to the time of installation of the tuning pins. For best results the holes should be drilled through the panel at an angle of 90 degrees to its upper surface. An upper compliance element, preferably a Belleville type spring washer, indicated in cross section at 15, is assembled onto the core below the collar so as to adjoin the upper surface of the tuning pin panel. In FIG. 2, core 12 with collar 13 and upper compliance element 15 assembled onto it, is shown inserted into an unthreaded mounting hole 19 in the panel. The core should fit into the hole snugly but without interference. For example, if the core has a diameter of 0.301" (7.645 mm), then the mounting hole should be drilled with a letter N drill, which has a diameter of 0.302" (7.671 mm). If the invention is used to replace conventional tuning pins on a string plate having existing panel holes that are too large, bushings of the correct outer diameter to fit the panel holes and the correct inner diameter to fit the cores may be fitted into the holes. The thickness of the panel 16 is not critical but it is preferable that it be at least equal to the diameter of the core. Panels of 5/16" (7.94 mm) to ⅜" (9.53 mm) thickness are commonly used with conventional tuning pins and are adequate for use with the invention. In general, the thicker the panel, the less will be the wear of both the core and the panel hole. However, wear of these parts has been found to be relatively small, even for panels as thin as ¼" (6.35 mm). A lower compliance element 20, preferably a Belleville type spring washer identical to upper compliance element 15, is shown in cross section adjoining the lower surface 18 of the panel. The center holes of the spring washers that are used as compliance elements preferably should be only slightly larger than the outer diameter of the core, so that the compliance elements will center themselves automatically on the core. In this embodiment the compliance elements also serve as friction elements. The multiple functions of the compliance elements and the selection and sizing of spring washers to be used both as compliance elements and friction elements will be discussed fully later.

Referring again to FIG. 2, a locknut 21 having internal threads complementary to the external threads of the core and have a substantially flat bearing surface 22 extending in a direction at substantially 90 degrees to the central axis of the core, is used to attach the tuning pin to the panel. The locknut also serves as an adjustment means for setting the torque of the pin. The locknut is preferably of the one-piece, all-metal, steel, slotted-top, prevailing torque type. The trade name of one manufacturer for this type of locknut is FLEXLOC.- The use of this particular type of locknut is not essential to the invention. It is possible to use almost any type of locknut that can develop sufficient torque. However, the one-piece, all-metal, steel, slotted-top locknut, which derives its holding power from top tabs, indicated at 23, 24 and 25, that are bent inwardly so as to impinge upon the male screw threads of the core, has been found to be the most satisfactory of several types that have been tested. It has been found that the use of one or more lubricated friction interface enhances greatly the performance of the tuning pin. The embodiment of FIG. 2 has two lubricated friction interfaces, an upper lubricated friction interface, and a lower lubricated friction interface. A lubricated friction interface as defined herein comprises a movable friction element, a stationary friction element in intimate proximity with the movable friction element, and a film of lubricant material situated between said movable and said stationary friction elements, the movable friction element being arranged to rotate in synchronism with the core during tuning, the stationary friction element being arranged to remain fixed with respect to the panel during tuning. In the embodiment of FIG. 2 the bearing surface 14 of the collar forms the movable friction element of the upper lubricated friction interface, while upper compliance element 15 forms the stationary friction element. The lower lubricated friction interface is formed by the bearing surface 22 of the locknut as the movable friction element and the lower compliance element 20 as the stationary friction element. Belleville type spring washers have been found to be particularly well suited for use as friction elements and compliance elements as will be explained fully later.

During tuning, as the installed tuning pin is rotated about its central axis, friction between the movable and the stationary friction elements produces a restraining torque that opposes rotation of the pin. It has been found that certain lubricants, if applied within the friction interfaces, will make the movement of the pin exceptionally smooth during tuning, will prevent stick-slip, a jerky motion of the pin, will lengthen greatly the life of the pin, and will at the same time permit the development of more than adequate values of pin torque. Certain hydrodynamic (liquid) lubricants, such as lithium grease, and lithium grease with fine aluminum or copper particles added to it, and certain solid lubricants, also known as dry film lubricants, such as those having bases of molybdenum disulfide ($MoS_2$), have been found to be especially effective for lubricating these interfaces. The use of solid lubricants will be discussed more fully in the description of another embodiment of the invention. In the embodiment of FIG. 2, during tuning, relative motion takes place between the bearing surface 14 of the collar and the adjoining surface of the upper compliance element 15, and also between the bearing surface 22 of the locknut and the adjoining surface of the lower compliance element 20. A film of lubricant material, which may be a hydrodynamic (liquid) lubricant material such as grease or a solid (dry film) lubricant material, indicated at 26 and 27, is applied to the friction interface surfaces of the compliance elements. In this embodiment, the core, the collar, and the locknut rotate together during tuning, while the Belleville type spring washers that form compliance elements 15 and 20 remain in a fixed position on the panel. The spring washers remain fixed on the panel because a much larger coefficient of friction exists between the spring washers and the panel than exists between the spring washers and the collar or the locknut, due to the lubricant material that is present within the friction interfaces. Lubricant is not applied between the compliance elements 15 and 20 and the panel surfaces 17 and 18. Even though the spring washers are flattened substantially as the tuning pin is installed, and, in fact, will lose almost all of their conical shape when the pin is adjusted to normal working torque, the outer peripheral edges of the spring washers will tend to embed themselves into the surfaces of the panel, and the spring washers will not turn with the core. Lubricant material may be placed within the friction interfaces either prior to or during assembly of the pin to the panel. Hydrodynamic lubricant such as grease may be applied either to the movable friction elements or to the stationary friction elements or to the facing surfaces of both. It has been found to be beneficial to apply some lubricant to the periphery of the core in that region where it will contact the walls of the panel hole. Solid lubricant material may be coated either onto the surfaces of the compliance elements as indicated at 26 and 27 in FIG. 2, or it could alternatively be coated onto the bearing surfaces 14 and 22 of the collar and the locknut.

The collar normally will already have been positioned and secured on the core before the tuning pin is to be mounted onto the panel. Upper compliance element 15, normally a Belleville type spring washer, can be preassembled onto the core or may be placed on the panel at its proper location. In mounting the tuning pin, the threaded portion of the core may then be introduced into the panel mounting hole. Lower compliance element 20, normally another Belleville type spring washer, and locknut 21 are next assembled onto the projecting threaded portion of the core, the threads of the locknut being engaged with the threads of the core. If a hydrodynamic lubricant such as grease is to be used, it may be applied to the parts prior to or during mounting of the pin to the panel. Locknut 21 can be held fixed while the core is tightened with a socket wrench engaging its tapered flats, or the locknut may instead be tightened while the core is restrained. As the locknut is tightened, the friction elements will be compressed together and forced adjustably into intimate proximity. Pin torque may be set according to the "feel" of the pin, or with the aid of a torque wrench, or preferably by means of an automatic wrenching tool that can be adjusted to tighten to a preset value of torque. It should be pointed out that the wrenching torque required to adjust the tightness of the pin with the locknut restrained will always be larger than the "free" torque required to turn the pin in the absence of locknut restraint. The "free" torque will normally be the same for clockwise as for counterclockwise pin rotation.

A suitable value for initial "free" pin torque will usually be about 100 to 115 inch-pounds (11.3 to 13.0 Newton-meters) The measured torque value will change when a string is installed. To illustrate, if a piano string of 0.041" (1.041 mm) diameter having a tension of 170 lb. (77.11 kg) is coiled on a pin 0.301" (7.645 mm) in diameter that has a torque without the string of 105 in-lb (11.86 Newton-meter), the string will produce on the pin a torque, assumed to be counter-clockwise, of about 30 in-lb (3.39 Newton-meter). Therefore, the torque required to turn the pin in a clockwise direction will increase from 105 to 135 in-lb (11.86 to 15.25 Newton-meter), and the torque required to turn the pin counter-clockwise will decrease from 105 to 75 in-lb (11.86 to 8.475 Newton-meter). These values are within the range considered by piano tuners to be optimum. The working tension of each piano string will be known in advance by the manufacturer and, through calculations based on this information, the required "free" pin torque can be determined and pre-set, before the strings are installed, so that the torque after stringing will be in the desired range. Pin torque can be readjusted very accurately to a specific value with the strings in place; however such an adjustment may not be necessary.

In order for the tuning pin shown by FIG. 2 to have the best operating characteristics and the longest possible service life, the material used to form the collar, the compliance elements, and the locknut should have certain properties. The compliance elements will be discussed first. As those familiar with fasteners will know, Belleville type spring washers, sometimes called Belleville spring washers, or Belleville washers, or disc type springs, or disc springs, or coned disc springs, have the approximate form, in the unloaded or unstressed condition, of a hollow conic frustrum of finite wall thickness. In appearance they resemble flat washers, but instead of being flat, they are shaped like the base section of a hollow cone. Belleville type spring washers are usually made of high carbon spring steel, alloy steel or stainless steel. They normally have a Rockwell hardness in the range C43–51. Belleville type spring washers are readily available in a wide range of sizes and specifications and are normally employed either to act as springs or as a means to prevent bolts or nuts from loosening. In the latter application they are placed under the head of a bolt or under a nut, where they act to prevent loosening of the fastener by maintaining a tensile load on it, once it has been tightened. Reference material relating to the design and conventional use of Belleville type spring washers may be found in engineering literature, for example, MECHANICAL SPRINGS, by A. M. Wahl, McGraw-Hill Book Co., 2nd Ed., Chap. 13, pp155–175.

In the present invention the Belleville type spring washers have three unusual functions: they act as friction elements to generate torque; they act as wear-compensating compliance elements to maintain the torque at a nearly constant value throughout the life of the tuning pin; and they act as vernier elements, to make the pin torque vary gradually instead of abruptly as the locknut is tightened, thereby making it convenient to set the torque to a pre-determined value.

Belleville type spring washers have been found to be effective as friction elements in this invention. Their relatively high hardness provides surfaces that are resistant to wear. As a tuning pin is turned in order to tune a string, relative motion occurs between the Belleville type spring washers and other friction elements that interface with them. The life of the friction elements is extended by using materials that wear slowly and by lubricating the interfaces. Lubrication also makes the tuning pin turn very smoothly and by so doing makes tuning easier and faster. In one embodiment of the invention the friction elements interfacing with the Belleville type spring washers may be the collar and the locknut; in another embodiment the interfacing friction elements may be flat washers that are coated with a solid lubricant; in still another embodiment the interfacing friction elements may be the surfaces of the panel on which the tuning pins are mounted.

The Belleville type spring washers act to maintain a nearly constant force between their surfaces and the surfaces of the interfacing friction elements, even though wear of these surfaces may occur after many tunings. Other types of spring washers, such as wave spring washers, for example, might be used to perform this function, but Belleville type spring washers, if properly selected, provide larger interface surface area and give longer life. Coil springs might be used as compliance elements but, because they function poorly as friction elements, their use would generally require the use of separate friction elements, whereas Belleville type spring washers can serve both purposes. The specifications for Belleville type spring washers (hereinafter referred to as "spring washers") to be used in the invention can be determined as follows:

(a) The outer diameter of the spring washers should be as large as feasible but must be less than the distance between the centers of adjacent tuning pins in order to avoid mechanical interference. The distance between tuning pins will have been set by the designer of the piano and may typically be as small as 0.75" (1.9 cm), or a little less, from the center of one pin to the center of another.

(b) For best centering, the center hole of the spring washers should preferably be only slightly larger than the core diameter.

(c) The approximate required thickness for the spring washers can be found one their maximum allowable outer diameter and center hole size have been determined. In order to compensate best for wear, the spring washers should be just stiff enough so that they will be almost fully compressed to a flat condition by the force needed to produce the desired tuning pin torque. This requirement determines the minimum thickness of the spring washers. If the spring washers are too thin they will become fully flattened at less than the desired value of tuning pin torque, with the result that the torque will tend to decrease rapidly to some lower value as wear of the parts occurs. If the spring washers are too thick and therefore too stiff, the amount of wear that can successfully be compensated for will again be less than the maximum amount because the desired pin torque will be reached with only partial compression of the spring washers. Also, the change in pin torque for a given rotation of the locknut will be unnecessarily large and it may be difficult to adjust the pin torque precisely. Moreover, wear may be more rapid due to reduced friction interface area. These limitations determine the maximum thickness of the spring washers.

Based on engineering considerations it has been found that an approximate value for the compressive force required to produce a particular value of torque from a tuning pin of the embodiment shown by FIG. 2 will be given by the following equation:

$$F=T/(u\ D)$$

where:

F=the compressive force in pounds

T=the torque in inch-pounds u=the coefficient of friction

D=the mean diameter of the friction washers

The value of the coefficient of friction will not be known exactly because it depends on the exact nature of the friction surfaces, the area of contact between the surfaces, the characteristics of the lubricant, and other factors, but it will be assumed to lie between 0.1 and 0.2 and will be taken to be 0.12 for purposes of a sample calculation of the compressive force required to produce a pin torque of 100 in-lb (11.3 Newton-meter). The mean diameter of the friction interfaces will be taken to be 0.5" (1.27 cm), based on an outside diameter of the friction elements of 0.7" (1.78 cm) and a washer hole diameter of 0.3" (0.762 cm). If these values are substituted in the above equation, the approximate required compressive force F will be found to be 1666 lb (755.7 kg).

Data giving the allowable compressive load and the deflection for a particular load is available from manufacturers of spring washers, and equations are also available with which to calculate the compressive force for a given deflection of a particular washer. A commercially available spring washer that has been tested and found to be satisfactory for use in the invention is made of steel that has a Rockwell hardness of C43–50, an outside diameter of 0.709 inches (1.800 cm), a hole diameter of 0.331" (8.41 mm), a thickness of of 0.079" (2.0 mm), an unloaded height of 0.102" (2.59 mm), and a calculated fully-compressed load of 1753 pounds (795.1 kg). The measured height of these washers in the embodiment of FIG. 2 was found to be about 0.084" (2.13 mm), indicating nearly complete compression. With cores of 0.301" (7.645 mm) diameter it would be preferably to have the spring washer center hole no larger than 0.310" (7.87 mm) in order to give better centering of the washers on the core.

The angular rotation of the locknut in relation to the core that will produce a given change in pin torque could be increased by using core threads having a smaller pitch or by using additional spring washers. Several spring washers may be stacked in series in a manner to reduce the net spring constant, so as to require fewer pounds per inch of deflection and thus increase both the vernier effect and the amount of available wear compensation. In the preferred embodiments, two identical spring washers are employed, one spring washer being situated on either side of the tuning pin panel. This configuration gives double the vernier effect of a single spring washer and, in addition, provides two pairs of nearly identical friction surfaces, each pair of which will produce approximately one-half the friction. Additional spring washers could be used but experience indicates that the benefits do not appear to justify the increase in cost. Two spring washers have been found to give adequate wear compensation and long pin life. One embodiment of the invention uses only a single spring washer, but two identical spring washers have the advantages of producing two nearly identical friction interfaces so that wear characteristics can be better predicted and controlled, and of affording double the wear compensations of one spring washer.

In the embodiment shown by FIG. 2, the bearing surfaces of collar and the locknut act as movable friction elements and they interface with spring washers that act as stationary friction elements and that also serve as compliance elements. In order to obtain the longest possible tuning pin life, the rate of wear of the collar and the locknut should preferably be equal to or less than that of the spring washers. Test results indicate that the wear rates of the collar and the locknut depend on both the composition and the hardness of the material from which these parts are made. The least costly collars have been found to be standard high-production nuts that are made from a low carbon steel such as SEA 1015 or AISI C1015. It is preferable to use nuts meeting the size specifications of American Standard Heavy nuts or American Standard Heavy Jam nuts as collar nuts because they provide a greater bearing surface area to contact the spring washers. It is also preferable to specify that collar nuts be finished or semi finished in order that the bearing surface will be flat and perpendicular to the axis of the threaded hole within the smallest tolerance. Such nuts are readily available at low cost. However, data to be introduced later will show that the service life of low carbon steel collar nuts will be shortened in the embodiment of FIG. 2 unless the nuts are hardened. The hardness of standard low carbon steel nuts will typically be in the range of approximately Rockwell B70–B90. The best service life for nuts made with this steel has been found to occur for nuts that are hardened to within the range Rockwell C45–55 for depth of at least 0.01–0.02" (0.25–0.51 mm), a hardness that is similar to that of the spring washers. Tuning pins using collar nuts made of this steel have been found to have a shorter service life if the nuts are either appreciably harder than Rockwell C55 or appreciably softer than C45. To harden the nuts to this range is relatively inexpensive. It has been estimated that the cost of heat treatment to optimum hardness would be less than one cent per nut. Nuts of higher cost, such as those designated as 2H heavy nuts under ASTM Standard A194/A194M-87, which are formulated from a higher carbon steel such as SAE 1040 or AISI C1040 and have a Rockwell hardness in the range C24–38, have been found to give good service life without further hardening, but the cost of these nuts is normally much more than that of hardened low carbon steel nuts, which give equal or better service life. Locknuts used in the embodiment of FIG. 2 should also be hardened for longest service life. FLEXLOC type locknuts are normally made from carbon steel such as SAE 1021 and have a hardness as purchased of approximately Rockwell B90–95, but are readily hardenable. Testing has indicate that FLEXLOC nuts used as friction elements in the invention have the longest life if their surface hardness is within the range Rockwell C40–50. The use of FLEXLOC nuts of the so-called FULL HEIGHT HEAVY DUTY configuration is preferable because these have larger bearing surface area and also will normally provide greater prevailing torque than lighter duty FLEXLOC nuts.

Collars made from Class 40 cast iron and having a hardness around Rockwell C25–26 have been found to have a long service life and excellent resistance to wear, but cast iron nuts are not available as standard parts and are costly to make. The gray iron used to cast piano string plates is normally a Class 30 iron having 30000 psi (2109 kg per square cm) minimum tensile strength and is capable of reasonably good service life if used as a friction element. In an embodiment to be described later, the tuning pin panel surfaces of the string plate, rather than the bearing surfaces of the collar and the locknut, are used as friction elements.

The cores of the invention have threads that are similar to American National Standard UNC 5/16–18 threads except that the major diameter is smaller and the pitch diameter has been made larger than normal in order to provide greater locknut prevailing torque. The normal major or outside diameter of UNC 5/16–18 threads is 5/16" (0.3125") (7.937 mm), but the outer diameter of core threads can be no larger than the diameter of the core. The nominal core diameter is 0.301" (7.645 mm) in the embodiment described. As previously explained, the reasons for using cores of 0.301" (7.645 mm) diameter have only to do with convenience; a core of 0.3125" (7.937 mm) diameter would work just as well but 0.3125" (7.937 mm) does not correspond to any standard tuning pin size. If 0.301" (7.645 mm) diameter cores were to be threaded with 5/16–18 threading dies of normal size, a standard 5/16-18 nut would tend to fit on them somewhat loosely and would have less than normal prevailing torque. The torque required to turn the locknut relative to the core, if the threads of the nut are fully engaged with the threads of the core, is herein termed prevailing torque. If the prevailing torque of the locknut is too low, the locknut may either loosen or tighten during tuning, causing the pin torque to change, an undesirable result. The prevailing torque can be increased by increasing the minor diameter and pitch diameter of the core threads. Prevailing torque values of 90 in-lb (10.17 Newton-meter or more can be obtained with cores of 0.301" (7.645 mm) diameter when used with typical 5/16–18 FLEXLOC nuts, without excessive difficulty of assembly, by increasing the pitch diameter of the core threads from the nominal value of 0.2764" (7.02 mm) to a value of approximately 0.280–0.281" (7.11–7.14 mm), as indicated by a thread micrometer. The prevailing torque of the locknut will be still further increased by hardening the locknut, because the hardening process will produce a slight decrease in the diameter of its internal threads. In order to increase the minor diameter and the pitch diameter of the core it is only necessary to adjust the threading tool or die so that it will cut less deeply into the core than normal when forming the threads. In general, the locknut should have a prevailing torque at least equal to approximately one half the required free pin torque. Tuning pins of this invention can be made either with the collar formed separately from the core or with the collar forming an integral part of the core. The best method to use will depend upon the number of pins to be made. The method of choice for manufacturing small quantities of the pins is to use a separate collar. Existing equipment for manufacturing tuning pins could easily be converted to make cores for the invention by changing only the threading means. It has been discovered that cores can also be made by re-threading standard tuning pins. It has been found that the pre-existing threads on standard tuning pins do not interfere during rethreading or use in the invention of cores made by such rethreading. This discovery makes it economical to produce small quantities of the new pins. The method of choice for manufacturing very large quantities of the tuning pins appears to be to form the collar as an integral part of the core by a cold-forming process. The initial cost for tooling to cold-form the collar and core would be relatively large, hence the requirement for large quantities in order to produce a low unit cost. It would also be possible to machine the core with an integral collar but this would require stock as large in diameter as the collar and would entail relatively high machining cost as well as the waste of large amounts of material.

An advantage to be gained by forming the collar separately from the core is that the collar and the core can thereby easily be made to have different properties, whereas if the the collar is formed integrally with the core, both collar and core will have the same properties. In the embodiment of FIG. 2 there is no need for the core material to be as hard as the collar because the core is not subject to the same wear as the collar. The hardness of standard tuning pins is normally about Rockwell C25–29, a value that is also adequate for cores of the invention. But collars for the embodiment of FIG. 2 may require a hardness in the range Rockwell C45–55 for best results. If the collar and the core were to be made in one piece, both the core and the collar would have to be hardened, and the cost of this would be several times the cost of hardening the collar alone. If the collar is to form an integral part of the core it may therefore be advantageous to use an alternate embodiment of the tuning pin, to be described later, wherein hardening of the collar and the locknut is not required.

If a separate collar is used, any of several methods can be employed to secure the collar to the core so that it will function as an integral part of the core during tuning. These methods include the application of anerobic thread-locking compounds, or epoxy or other adhesives onto those threads of the collar and the core that will be in contact in a fully assembled tuning pin. Other methods such as spot welding the collar to the core could be used. The most convenient and least costly method of securing the collar to the core has been found to be screw the collar onto the core as far as it will go with normal tightening torque and then to tighten it further by increasing the applied torque to the range of 150 to 200 in-lb (16.95 to 22.6 Newton-meters). This procedure causes deformation of the threads of the collar and the core within the engagement area and gives a satisfactory value of securing torque. Tests have indicated that collars that have been properly secured by this method do not loosen in use. Where the collar is a separate part that is to be welded or otherwise very strongly bonded to the core, the collar need not be threaded but can be a threadless nut have an inside diameter approximately the same as the outer diameter of the core.

Figure 3:
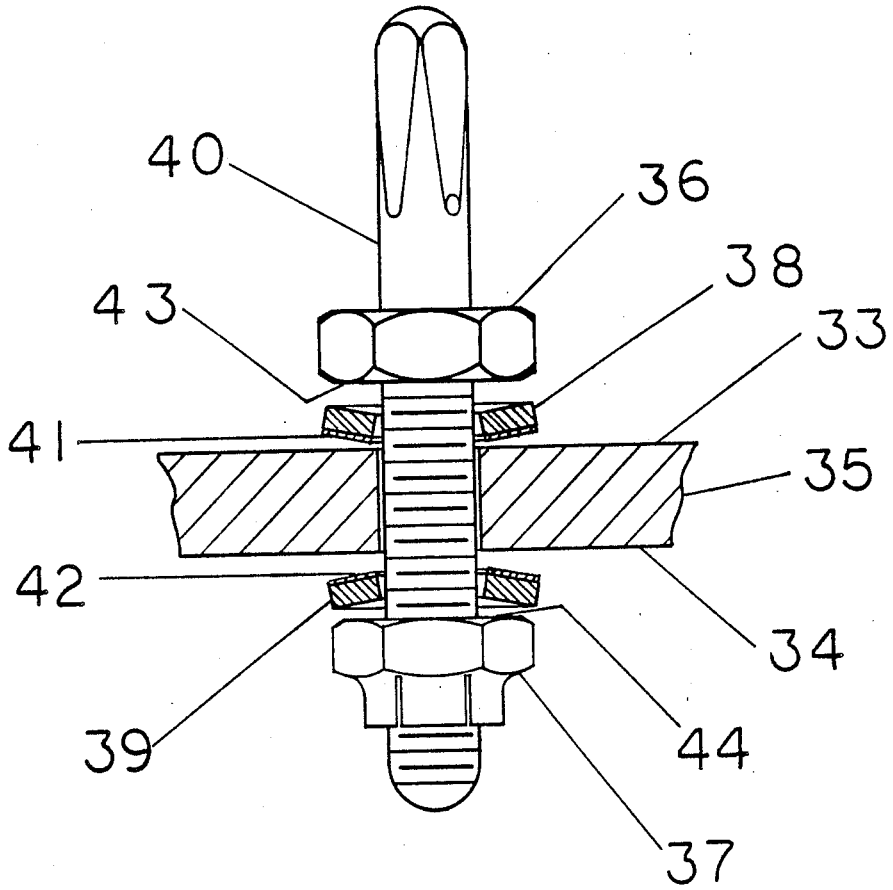

FIG. 3 shows a second embodiment of the invention. The elements again are shown spread apart slightly for clarity. In this embodiment the panel is indicated sectionally at 35 and its upper and lower surfaces 33 and 34 act as friction elements. The collar 36 and the locknut 37 are present and functional but do not act as friction elements. The tuning pin has an upper compliance element 38 adjoining the bearing surface 43 of the collar, and a lower compliance element 39 adjoining the bearing surface 44 of the locknut. The compliance elements, indicated in cross section, are Belleville type spring washers that also act as friction elements. During tuning, the spring washers and the collar and the locknut all turn together with the core 40. Lubricated friction interfaces are formed between the spring washers and the panel. The spring washers have been inverted so that their vertexes face the panel instead of the collar and the locknut as they do in FIG. 2. Films of lubricant material, indicated at 41 and 42, are situated between the panel and the spring washers. The lubricant material is shown by FIG. 3 to be coated onto the spring washers, but it could instead be coated onto the panel. Hardening of the collar and the locknut is unnecessary because during tuning there will be no relative motion between the collar and the adjoining spring washer or between the locknut and its adjoining spring washer. In this embodiment the upper lubricated friction interface comprises the upper compliance element 38 as the movable friction element and the upper surface of the panel 33 as the stationary friction element, while the lower lubricated friction interface comprises the lower compliance element 39 as the movable friction element and the lower surface of the panel 34 as the stationary friction element. Lubricant should not be applied between the bearing surface 43 of the collar and the upper compliance element 38 or between the bearing surface 44 of the locknut and the lower compliance element 39. This embodiment may be used with panels made of cast iron but is not suggested for use with steel panels because hardening of an entire panel or string plate would normally be impractical. The free carbon particles that are present in cast iron provide additional lubrication of the friction interface, making hardening unnecessary.

Figure 4:
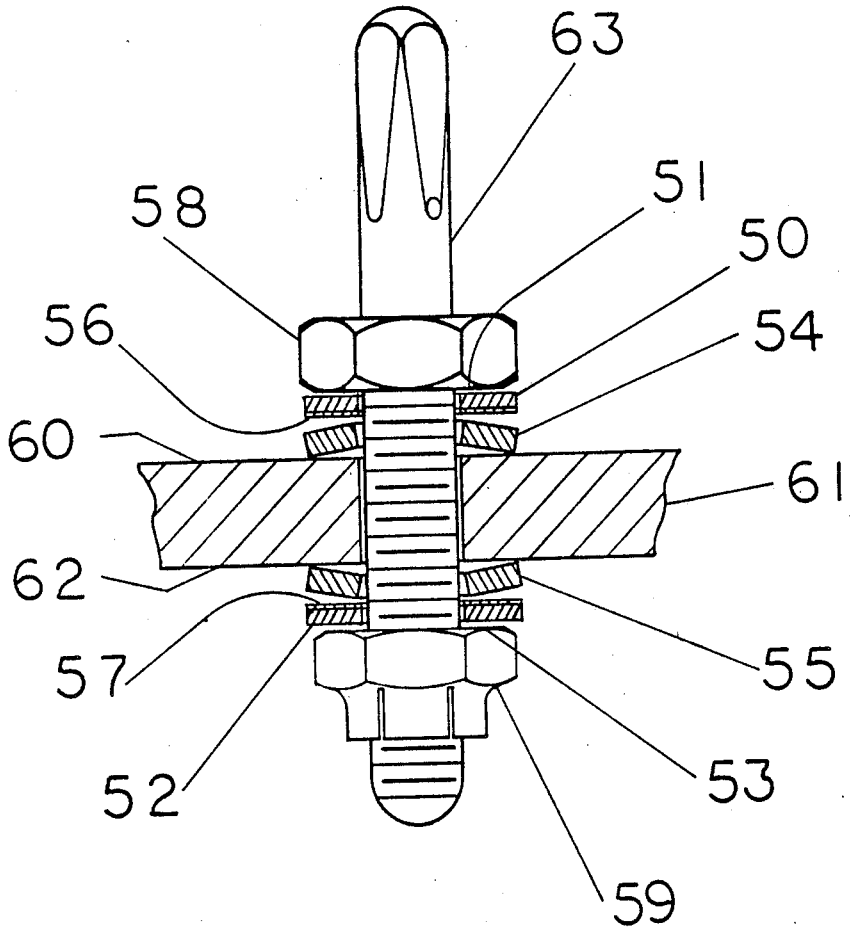

A third and also a preferred embodiment is shown by FIG. 4, wherein the core is indicated at 63 and the parts are shown slightly separated for clarity. In this embodiment, upper compliance element 54, adjoining the upper surface 60 of the tuning pin panel 61, is a Belleville type spring washer that forms the stationary friction element of an upper lubricated friction interface, while an upper flat washer 50, adjoining the bearing surface 51 of collar 58, forms the movable friction element. Lower compliance element 55, another Belleville type spring washer, adjoins the lower surface 62 of the panel and forms the stationary friction element of a lower lubricated friction interface, while a lower flat washer 52 adjoins the bearing surface 53 of locknut 59 and forms the movable friction element. A film of solid lubricant material 56, said solid lubricant material typically having molybdenum disulfide ($MoS_2$) as a major ingredient and being sometimes also referred to as a dry film lubricant, is coated onto that surface of upper flat washer 50 that adjoins upper compliance element 54, and a similar film of solid lubricant material 57 is coated onto that surface of flat washer 52 that adjoins lower compliance element 55. The compliance elements and the flat washers and the lubricant coatings and the panel all are shown sectionally in FIG. 4. Solid lubricant coatings that are suitable for use in this embodiment are available commercially and it is not intended to restrict the invention to the use of any one specific such commercial product. However, one commercially available product found to be suitable for use in this embodiment has the trade name Surf-Kote. The process for applying the solid lubricant coating to the surface to be coated normally comprises spraying or brushing a liquid solution of the lubricant onto the parts to be treated, and following this with an oven-cure process wherein the parts are baked at temperatures of several hundred degrees Fahrenheit, causing bonding of the lubricant material to the part which has been treated. The thickness of the solid lubricant film may typically be in the range from 0.0004" to 0.0008" (0.010 to 0.020 mm). Commercial solid lubricants normally are proprietary products and their manufacturers may decline to reveal their exact formulation and methods of preparation. However, the solid lubricant materials most successfully employed with the invention have contained molybdenum disulfide ($MoS_2$) as a major ingredient. Flat washers 50 and 52 are preferably made from steel or stainless steel and are not required to be as hard as friction elements that are used with hydrodynamic lubricants. Commercial stainless steel washers having a hardness less than Rockwell C20 have been found to provide good performance and long life. Flat washers 50 and 52 serve as substrates onto which the solid lubricant material can be coated. The surfaces onto which the solid lubricant is coated should be smooth and free from irregularities that could penetrate through the thin solid lubricant film to produce metal-to-metal contact between the friction elements. In this embodiment it is not necessary to harden either collar 58 or locknut 59 because during tuning there will be no relative motion between the collar and upper flat washer 50 or between the locknut and lower flat washer 52 and consequently there will be no wear to the mutually contacting surfaces of these parts. Flat washers 50 and 52 turn with the core 63 during tuning. The embodiment of FIG. 4 has the additional advantage that at the end of the life of the solid lubricant coating, the solid lubricant coating being one that normally can last for more then 1000 tunings, the flat washers can be replaced with new flat washers having a fresh coating of solid lubricant. The solid lubricant itself, though long lived, is relatively soft, and tends to abrade or wear away in use. So long as a film of solid lubricant is in place within the friction interface, and so long as the solid lubricant coating acts to prevent metal-to-metal contact between adjacent friction elements, no significant wear of the metal surfaces of the friction elements themselves will occur. The solid lubricant material normally will have been coated and bonded tightly onto the flat washers at some time prior to the mounting of the tuning pin, thereby ensuring that the solid lubricant coating will be dry to the touch and fully cured at the time of mounting. It will therefore be unnecessary to lubricate the parts at the time the tuning pin is mounted to the panel. The solid lubricant material alternatively could be bonded onto compliance elements 54 and 55 instead on onto flat washers 50 and 52 and such an arrangement would be functionally equivalent to the embodiment of FIG. 4.

Figure 5:
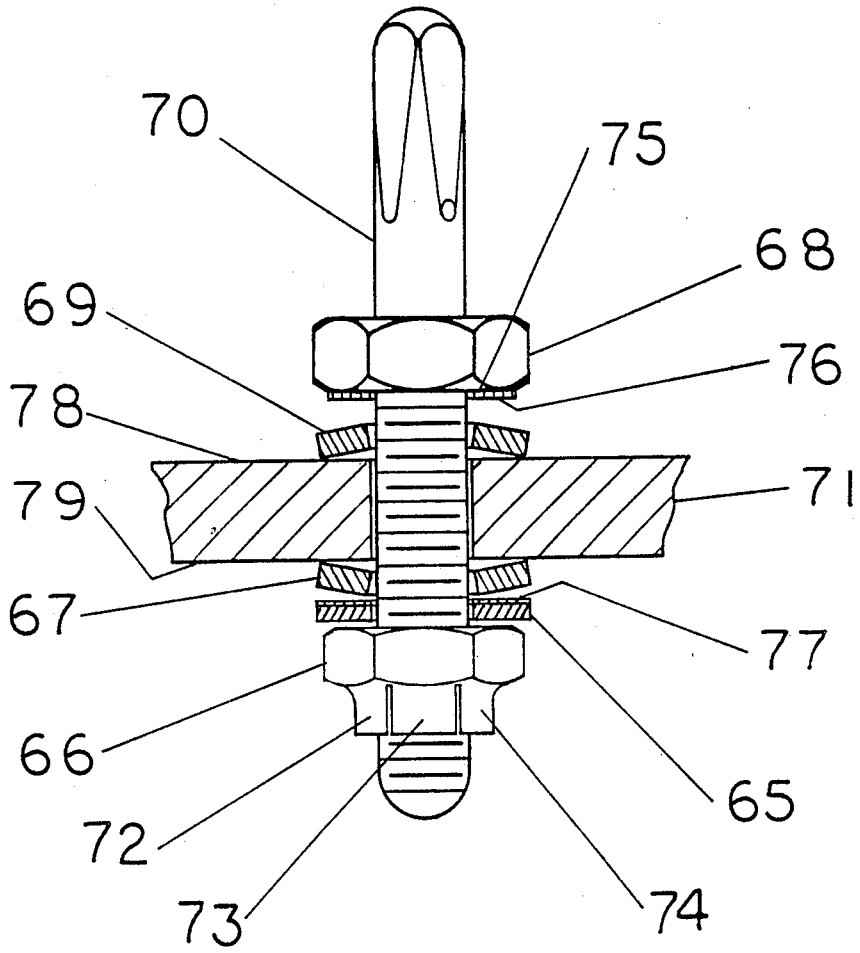

The lubricant material indicated at 56 and 57 in the embodiment of FIG. 4 can also be a hydrodynamic lubricant material. If a hydrodynamic lubricant material such as grease is used, it can be applied to flat washers 50 and 52 where indicated by FIG. 4 or it can be applied to those surfaces of compliance elements 54 and 55 that face flat washers 50 and 52. If a hydrodynamic lubricant material is used, flat washers 50 and 52 should be hardened for best performance and longest life of the tuning pin. As previously stated, the degree of hardness that is optimum may vary with the material of the flat washers. For flat washers made from carbon steel such as AISI C1015, optimum hardness will normally lie within the range Rockwell C45–55. For other materials a lower hardness may be satisfactory. FIG. 5 shows a fourth embodiment, similar to the one shown by FIG. 2 with the addition of a flat washer 65, shown in cross section, that adjoins the locknut 66 and is interposed between the locknut and a lower compliance element 67. Lower compliance element 67, adjoining the lower surface 79 of the panel 71, is a spring washer that also serves as a friction element. Flat washer 65 acts as the movable friction element of a lower lubricated friction interface, while the lower compliance element 67 acts as the stationary friction element. The flat washer 65 and the collar 68 should be hardened if a hydrodynamic lubricant material is used to lubricate the friction interfaces. An upper lubricated friction interface is formed by the bearing surface 75 of the collar 68 as the movable friction element and by the upper compliance element 69, adjoining the upper surface 78 of the panel, as the stationary friction element. During tuning, collar 68 and flat washer 65 and locknut 66 turn with the core 70, while compliance elements 67 and 69, shown in cross section, remain fixed with respect to panel 71. This embodiment can be used where it is considered undesirable to harden the locknut. It may be considered undesirable to harden some one-piece, all-metal, steel, slotted-top locknuts, especially if the hardening process is not well controlled, because excessive hardening could possibly lead to overstressing of the top tabs, indicated at 72, 73, and 74, of the locknut, causing failure of one or more of said top tabs. A film of lubricant material 76 is shown coated onto the bearing surface 75 of the collar, and a similar film of lubricant material 77 is shown coated onto the friction interface surface of the flat washer. The lubricant material could instead be coated onto the friction interface surfaces of the compliance elements.

Figure 6:
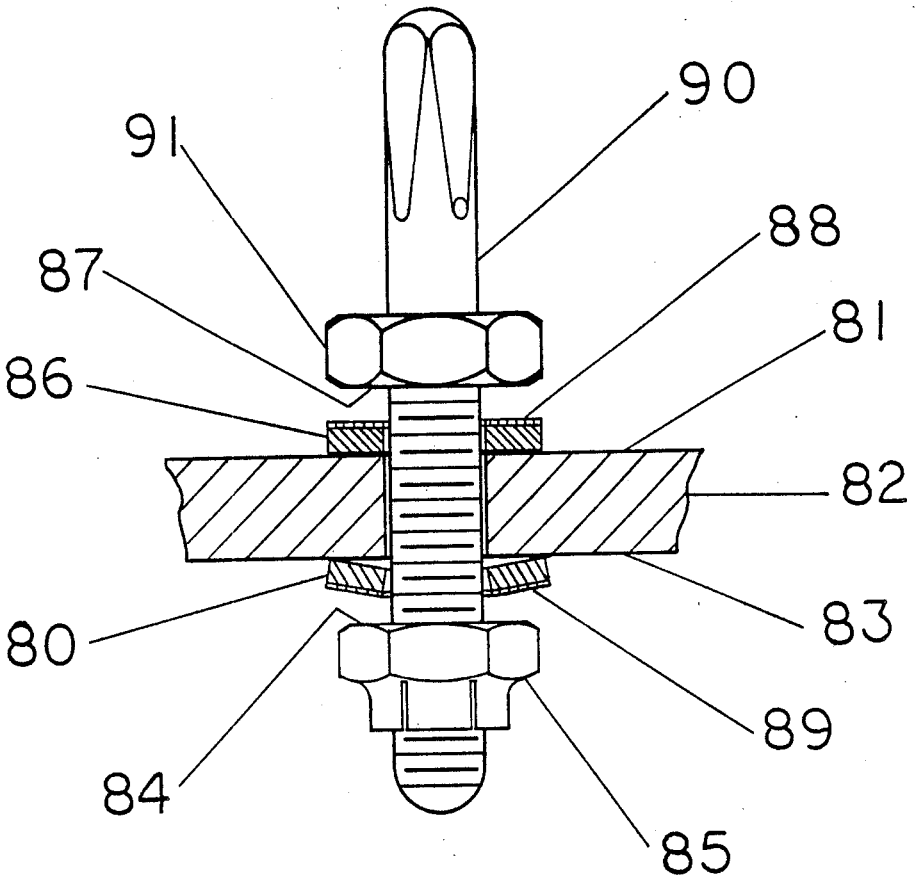

Whereas the best performance of the invention is to be expected from embodiments having a balanced configuration, by which is meant a configuration having the same types of friction elements both above and below the panel, it is nevertheless possible to use an unbalanced configuration, such as in a fifth embodiment, shown by FIG. 6. In this embodiment, compliance element 80, a Belleville type spring washer adjoins the lower surface 83 of tuning pin panel 82, and forms the stationary friction element of a lower lubricated friction interface, while the bearing surface 84 of locknut 85 forms the movable friction element. A flat washer 86 adjoins the upper surface 81 of the panel and forms the stationary element of an upper lubricated friction interface, while the bearing surface 87 of the collar 91 forms the movable friction element. A film of lubricant material 88 is coated onto the friction interface surface of the flat washer, and a similar film of lubricant material 89 is coated onto the friction interface surface of compliance element 80. The core is indicated at 90. The compliance element, the flat washer, and the lubricant films all are shown in cross section. This embodiment can give approximately one half the wear-compensating capability and one half the vernier adjustment effect of the balanced embodiments shown by FIGS. 2, 3, 4, and 5. This configuration could be used to reduce the cost of the tuning pin for low cost grand pianos or upright pianos. The embodiment will work equally well with the positions of compliance element 80 and flat washer 86 interchanged.

Figure 7:
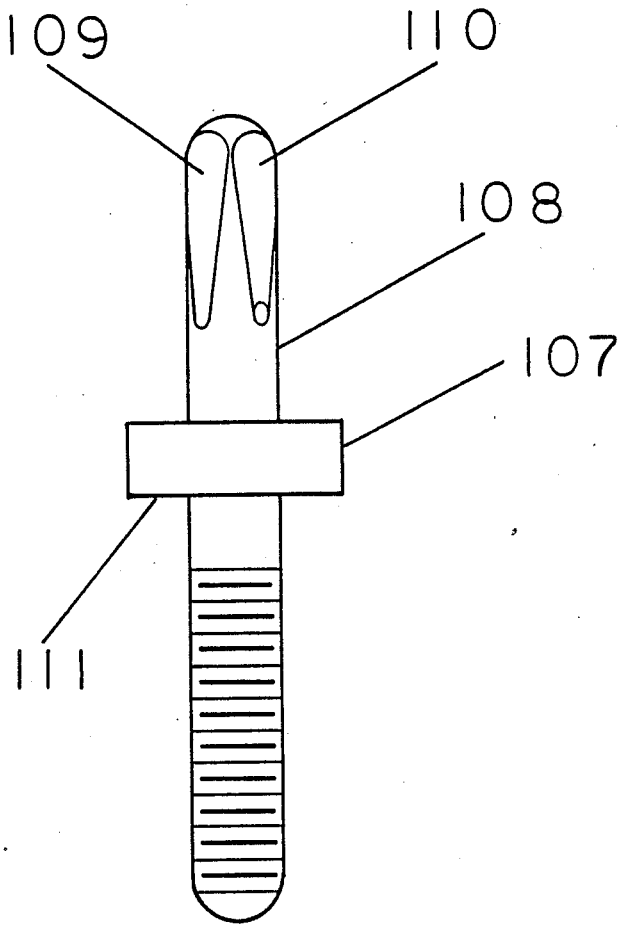
FIG. 7 is a side elevation view of an alternate configuration of the core.

As has previously been explained, any of the tuning pin embodiments that have been described herein can be configured in either of the following two different ways: the collar may either form an integral part of the core or the collar may be formed separately from the core. If the collar is formed separately from the core, the collar can be a nut having internal threads complementary to the external threads of the core, or it can be a threadless nut or bushing having an inside diameter approximately the same as the outer diameter of the core. In either case the collar can be assembled onto the core and secured to the core by any of several methods so as to function as an integral part of the core during tuning. The decision whether to use one or the other construction should be based on the number of pins to be manufactured and on the relative cost and convenience of manufacture and use. FIG. 1 shows a core for which the collar is formed separately. FIG. 7 shows a core and collar wherein the collar forms an integral part of the core. The collar 107 and the core 108, and the tapered flats, indicated at 109 and 110, may be cold formed as one piece. In this configuration the collar does not require wrenching flats. However, the bearing surface of the collar is required to be smooth and to extend accurately in a direction at 90 degrees to the central axis of the core so that the bearing surface will be perpendicular to the axis of the case threads. In this configuration it is not necessary for the case threads to extend fully to the bearing surface of the collar.

The operation and advantages of the invention can best be understood by reference to graphs showing test results for tuning pins that were life-tested under standard conditions. In these tests the pins were installed on a test frame that simulated a piano. A test string made of music wire 0.041" (1.041 mm) in diameter with a normal tension of 170 lb (77.11 kg) was installed on each test pin. The pins were "tuned" automatically by a machine that simulated tunings by a piano tuner. For each "tuning" a pin was rotated approximately plus and minus 15 degrees from a reference position, causing the string tension to vary accordingly. Pins were rotated slowly enough to insure that the parts remained essentially at ambient room temperature during the test. The testing machine was set to stop automatically after a preset number of tunings so that pin torque could be remeasured and tuning smoothness re-tested at intervals by tuning the string manually. A test normally was continued until tunability become unsatisfactory due either to excessive looseness or tightness of the pin or due to irregular torque or "stick-slip" that made if difficult or impossible to tune the string accurately.

Figure 8:
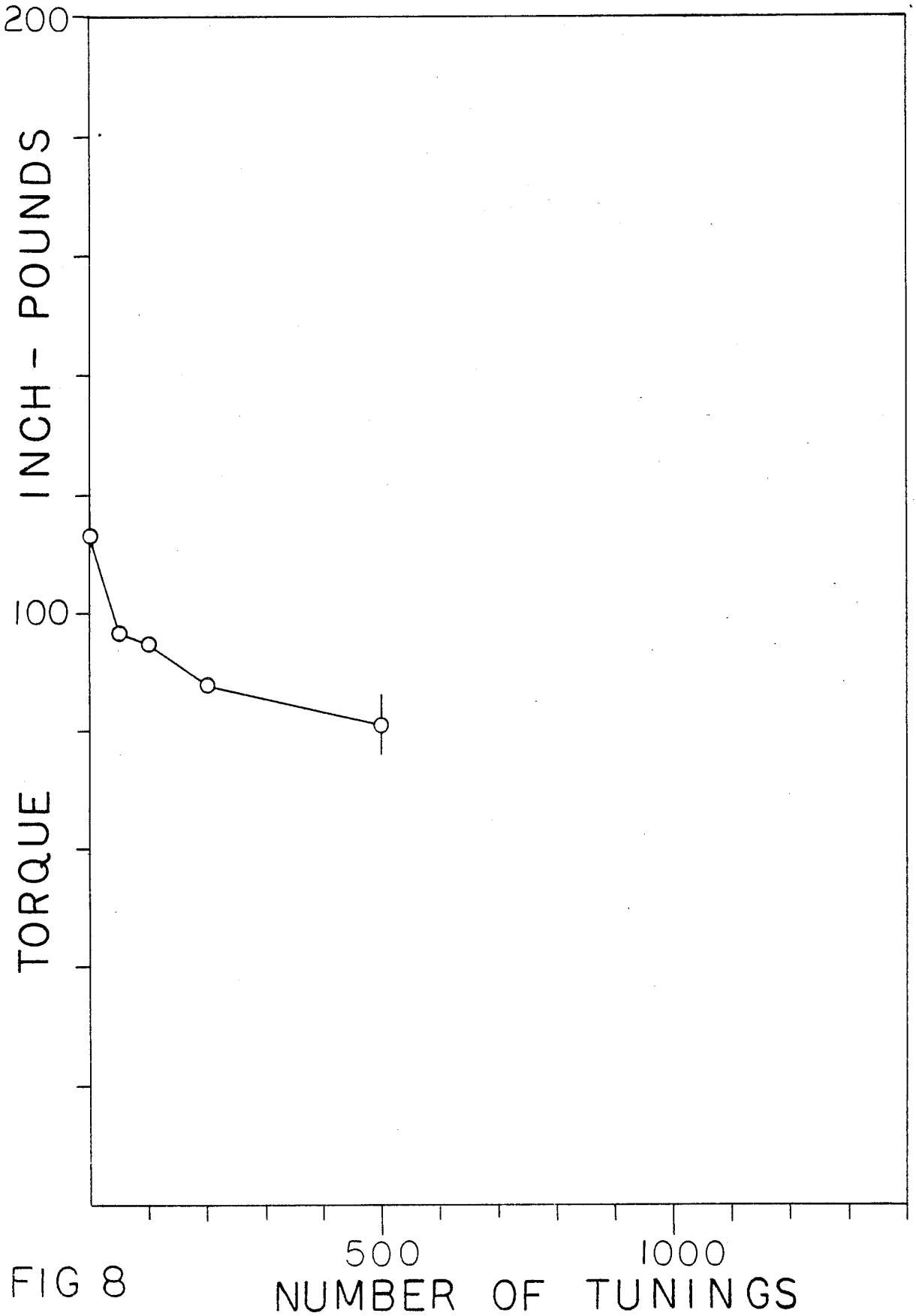
FIG. 8 is a graph showing life test performance results for a conventional tuning pin.

FIG. 8 is a graph showing how the torque of a conventional tuning pin varied with the number of tunings during a life-test. The pin was installed to a depth of 1.2" (3.0) cm) in a good quality wooden pin block. The horizontal axis shows the number of tunings and the vertical axis shows the measured torque values required to initiate rotation of the pin in the direction to decrease the string tension. Before each torque reading the string was tuned to a standard reference frequency corresponding to approximately 170 lb (77.11 kg) tension. FIG. 8 shows that the torque of the pin was 113 in-lb (12.77 Newton-meters) at the beginning of the test and that it dropped to 88 in-lb (9.94 N-m) at the end of 200 tunings. After 500 tunings it was impossible to tune the string accurately with this pin due to excessive ratcheting of the pin, also known as "stick-slip". Pin torque continued to drop and was 74 in-lb (8.36 N-m) after 800 tunings. The vertical line through the curve at 500 tunings indicates the end of the useful life of the pin.

Figure 9:
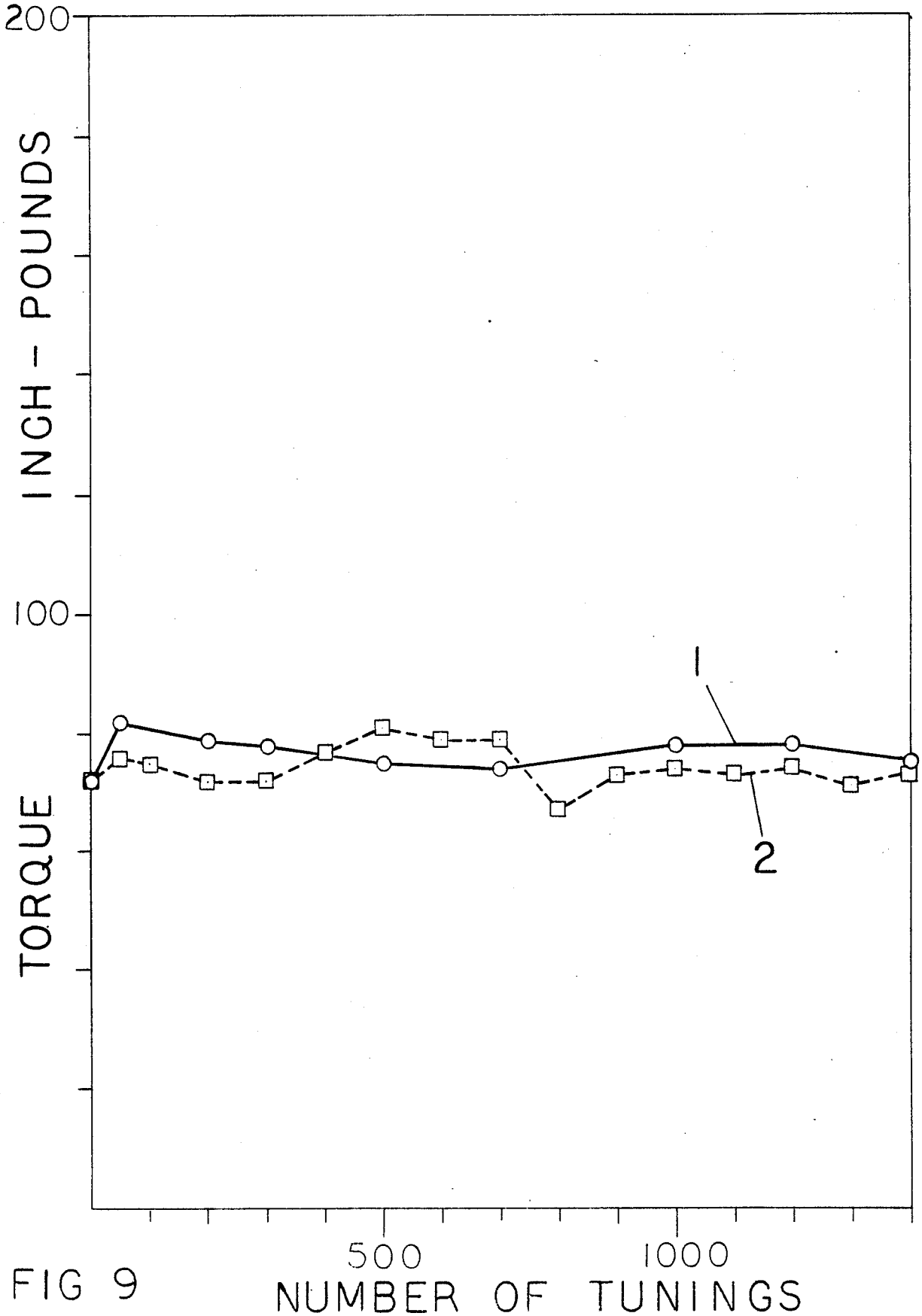
FIG. 9 is a graph showing life test performance results for two embodiments of the invention.

FIG. 9 shows life test results for tuning pins of two different embodiments of the invention that were tested according to the method just described. Curve 1 of FIG. 9 shows test results for the embodiment of FIG. 5. The collar and the flat washer were made from low carbon steel that was hardened to Rockwell C51–52. The lubricant material was white lithium grease. The tuning pin maintained nearly constant torque at 77±5 in-lb (8.70±0.56 N-m) and smooth performance through more than 1400 tunings. Curve 2 of FIG. 9 shows similar results for a tuning pin of the embodiment of FIG. 4. The lubricant material was a commercial solid lubricant having molybdenum disulfide as a major ingredient. The flat washers were made from stainless steel having a hardness less than Rockwell C20. This tuning pin also maintained a nearly constant torque of 74±7 in-lb (8.36±0.79 N-m) and smooth performance through more than 1400 tunings. The curves show that excellent performance can be obtained with either hydrodynamic or solid lubricants.

Figure 10:
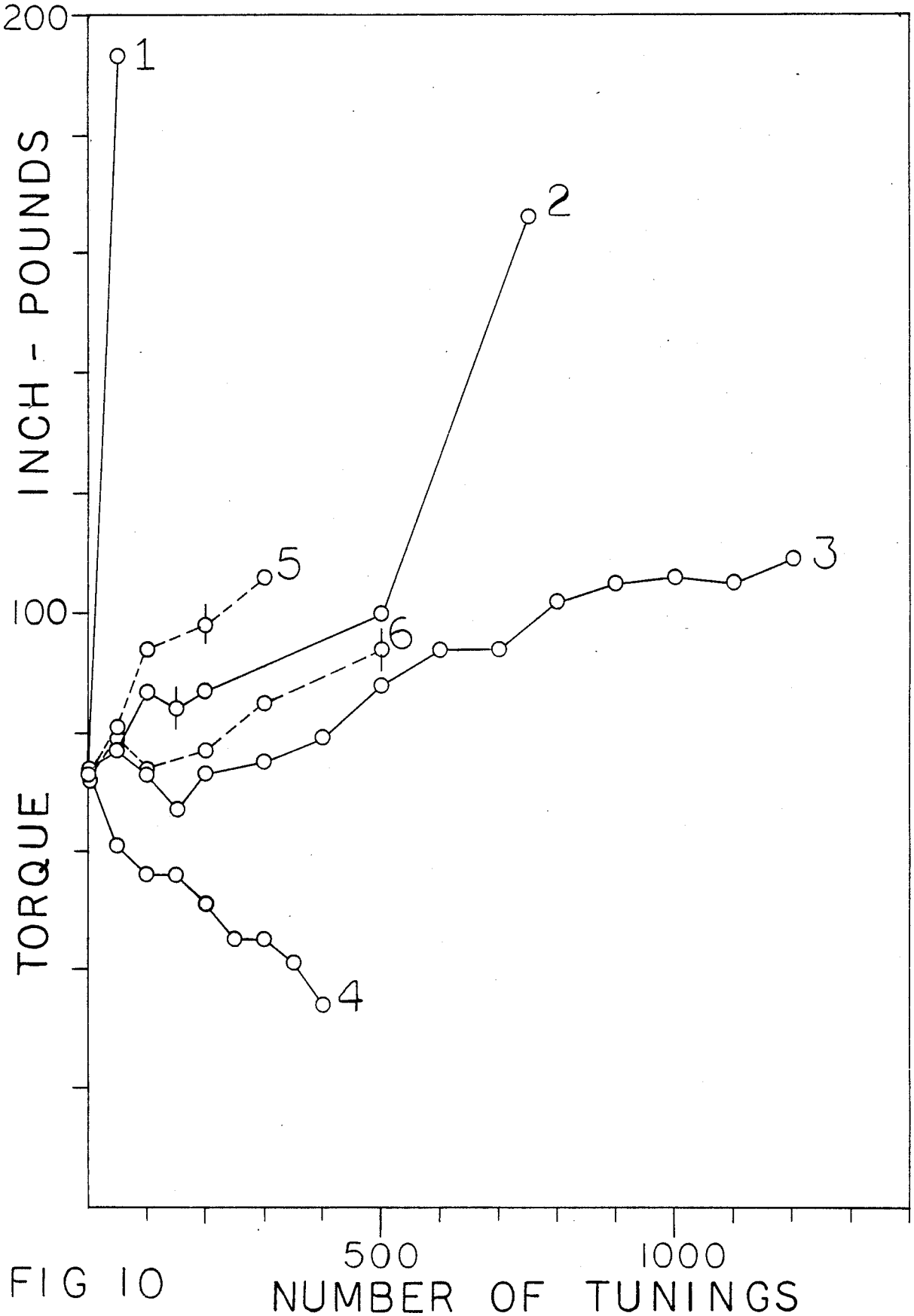
FIG. 10 is a graph showing the effect on life test performance results of changing some critical parameters of the invention.

FIG. 10 displays several curves of life test results that show the effect on performance of varying the parameters of the invention.

Curve 1 of FIG. 10 shows the effect of omitting the lubricant film. The test pin had the embodiment of FIG. 5. Without lubrication the torque of the pin increased from an initial value of 73 in-lb (8.25 N-m) to 197 in-lb (22.26 N-m) after only 50 tunings. The curve shows a severely overcompensated torque characteristic that was found to be due to a build-up within the friction interfaces of wear particles and debris from the friction elements. Inspection of the friction elements after the test indicated severe wear.

Curve 2 of FIG. 10 shows the results for a tuning pin identical to that of Curve 1 except that the friction interfaces were lubricated with petroleum jelly. This pin became unsatisfactory for tuning after 150 tunings, as indicated by the vertical line through the curve. The torque characteristic again appears severely overcompensated. The initial torque was 74 in-lb (8.36 N-m) and after 750 tunings had increased to 166 in-lb (18.76 N-m).

Curve 3 of FIG. 10 shows the results for a tuning pin identical to that of curves 1 and 2 except that the friction interfaces were lubricated with white lithium grease. This pin still operated smoothly after 1200 tunings. The torque characteristic appears moderately overcompensated, the torque having increased from an initial value of 74 in-lb (8.36 N-m) to 109 in-lb (12.32 N-m) after 1200 tunings. Moderate overcompensation appears typical for hydrodynamically lubricated tuning pins of the invention that employ relatively soft friction elements. The movable friction elements for the tuning pins of curves 1 through 3 of FIG. 10 were made from a medium carbon steel such as AISI C1040 having a hardness of Rockwell 26–28. The collar was a standard nut of grade 2H according to ASTM Standard A194/A194M-87. Tuning pins of the invention generally respond to wear by exhibiting an increase in torque, whereas conventional pins respond to wear by a decrease in torque. It should be understood that the torque of pins of the invention can be reduced at any time by adjusting the locknut, whereas there is no satisfactory way to adjust the torque of a conventional tuning pin.

Curve 4 of FIG. 10 shows the effect of gross undercompensation of a tuning pin of the invention. The curve shows a rapid drop in torque from an initial value of 74 in-lb (8.36 N-m) to 34 in-lb (3.84 N-m) after 400 tunings. This result was obtained by substituting flat washers in place of the Belleville type spring washers normally used as compliance elements in the embodiment of FIG. 5. The result illustrates the importance of compliance elements in maintaining constant pin torque by compensating for wear of the friction elements.

Curves 5 and 6 of FIG. 10 show the effect of friction element hardness on the performance of a pin of the embodiment of FIG. 5. The pins for curves 5 and 6 has relatively short life but were in fact identical to the long lived pin of Curve 1 of FIG. 9 except for the hardness of the collar and the flat washer. The collar and the flat washer for all three tuning pins were made from a low carbon steel such as AISI C1015 that was hardened by heat treatment. The collar the the flat washer of the pin of Curve 5 were given a surface hardness of Rockwell C40 and the pin became became unsatisfactory after 200 tunings. The collar and the flat washer of the pin of Curve 6 had a surface hardness of Rockwell C60 and the pin became unsatisfactory after 500 tunings. The collar and the flat washer of the long lived pin of FIG. 9 Curve 1 had a hardness of Rockwell C51–52. It is therefore evident that the hardness of the friction elements is important in determining tuning pin life and that a relatively small variation in hardness can cause a large difference in the longevity of the tuning pin. The hardness of the Belleville type spring washers used in all of the above tests was Rockwell C42–44.

What is claimed is:

1. In a piano having a string plate, a tuning pin for mounting on the string plate, the string plate being of any type providing a panel for tuning pins, the panel being of substantially uniform thickness and having a substantially flat upper surface and a lower surface substantially parallel with the upper surface, the panel having a mounting hole for the tuning pin, the mounting hole passing through the panel at an angle of substantially 90 degrees to the upper surface, the tuning pin comprising:

(a) a core, said core being generally cylindrical and having a central axis and having a length equal to several times its diameter, the core comprising a threaded portion and an unthreaded portion, the threaded portion comprising external screw threads beginning near one end of the core and ending intermediate the length of the core, the unthreaded portion comprising means to attach a piano string and means to engage a tuning tool;

(b) a lubricated friction interface, said lubricated friction interface comprising a movable friction element coaxial with the core, a stationary friction element in intimate proximity with the movable friction element, and a film of lubricant material situated between said movable and said stationary friction elements, the movable friction element being arranged to rotate in synchronism with the core during tuning, the stationary friction element being arranged to remain fixed with respect to the panel during tuning, the movable and the stationary friction elements being adjustably compressed together when the tuning pin is operational, the lubricant material being characterized by greases and dry film lubricants;

(c) a collar, said collar being coaxial with the core and being positioned on the core and being secured to the core so as to function as an integral part of the core during tuning, the collar having a bearing surface, the bearing surface of the collar being substantially flat and being generally annular and being larger diametrically than the core and facing toward the threaded portion of the core and extending in a direction at substantially 90 degrees to the central axis of the core, the bearing surface of the collar being a movable friction element;

(d) a lock nut, said locknut having internal threads complementary to the external threads of the core, the locknut having a bearing surface, the bearing surface of the locknut being substantially flat and being generally annular and being larger diametrally than the core and extending in a direction at substantially 90 degrees to the central axis of the core and facing toward the collar;

(e) a compliance element, said compliance element being assembled coaxially onto the core and being situated between the collar and the locknut;

(f) so that the elements of the tuning pin may be assembled and mounted onto the panel, the mounting procedure comprising introducing the threaded portion of the core into the mounting hole, engaging the threads of the locknut with the threads of the core, and adjustably tightening the locknut.

2. A tuning pin according to claim 1 wherein the collar forms an integral part of the core, the tuning pin having an upper compliance element adjoining the upper surface of the panel and a lower compliance element adjoining the lower surface of the panel, said upper and said lower compliance elements comprising spring washers assembled coaxially onto the core, said upper and said lower compliance elements being stationary friction elements, the tuning pin having an upper lubricated friction interface and a lower lubricated friction interface, the upper lubricated friction interface comprising the bearing surface of the collar as the movable friction element and the upper compliance element as the stationary friction element, the lower lubricated friction interface comprising the bearing surface of the locknut as the movable friction element and the lower compliance element as the stationary friction element.

3. A tuning pin according to claim 1 wherein the collar is formed separately from the core, the collar being assembled onto the core and being secured to the core so as to function as an integral part of the core during tuning, the tuning pin having an upper compliance element adjoining the upper surface of the panel and a lower compliance element adjoining the lower surface of the panel, said upper and said lower compliance elements comprising spring washers assembled coaxially onto the core, said upper and said lower compliance elements being stationary friction elements, the tuning pin having an upper lubricated friction interface and a lower lubricated friction interface, the upper lubricated friction interface comprising the bearing surface of the collar as the movable friction element and the upper compliance element as the stationary friction element, the lower lubricated friction interface comprising the bearing surface of the locknut as the movable friction element and the lower compliance element as the stationary friction element.

4. A tuning pin according to claim 1 wherein the collar forms an integral part of the core, the tuning pin having an upper compliance element adjoining the upper surface of the panel and a lower compliance element adjoining the lower surface of the panel, said upper and said lower compliance elements comprising spring washers assembled coaxially onto the core, said upper and said lower compliance elements being stationary friction elements, the tuning pin further comprising a flat washer assembled coaxially onto the core and situated between the lower compliance element and the locknut, the flat washer being a movable friction element, and tuning pin having an upper lubricated friction interface and a lower lubricated friction interface, the upper lubricated friction interface comprising the bearing surface of the collar as the movable friction element and the upper compliance element as the stationary friction element, the lower lubricated friction interace comprising the flat washer as the movable friction element and the lower compliance element as the stationary friction element.

5. A tuning pin according to claim 1 wherein the collar is formed separately from the core, the collar being assembled onto the core and being secured to the core so as to function as an integral part of the core during tuning, the tuning pin having an upper compliance element adjoining the upper surface of the panel and a lower compliance element adjoining the lower surface of the panel, said upper and said lower compliance elements comprising spring washers assembled coaxially onto the core, said upper and said lower compliance elements being stationary friction elements, the tuning pin further comprising a flat washer assembled coaxially onto the core and situated between the lower compliance element and the locknut, the flat washer being a movable friction element, and tuning pin having an upper lubricated friction interface and a lower lubricated friction interface, the upper lubricated friction interface comprising the bearing surface of the collar as the movable friction element and the upper compliance element as the stationary friction element, the lower lubricated friction interface comprising the flat washer as the movable friction element and the lower compliance element as the stationary friction element.

6. A tuning pin according to claim 1 wherein the collar forms an integral part of the core, the tuning pin further comprising a flat washer assembled coaxially onto the core and situated adjoining the upper surface of the panel, the flat washer being a stationary friction element, the tuning pin having a compliance element adjoining the lower surface of the panel, the compliance element comprising a spring washer assembled coaxially onto the core, the compliance element being a stationary friction element, the tuning pin having an upper lubricated friction interface and a lower lubricated friction interface, the upper lubricated friction interface comprising the bearing surface of the collar as the movable friction element and the flat washer as the stationary friction element, the lower lubricated friction interface comprising the bearing surface of the locknut as the movable friction element and the compliance element as the stationary friction element.

7. A tuning pin according to claim 1 wherein the collar is formed separately from the core, the collar being assembled onto the core and being secured to the core so as to function as an integral part of the core during tuning, the tuning pin further comprising a flat washer assembled coaxially onto the core and situated adjoining the upper surface of the panel, the flat washer being a stationary friction element, the tuning pin having a compliance element adjoining the lower surface of the panel, the compliance element comprising a spring washer assembled coaxially onto the core, the compliance element being a stationary friction element, the tuning pin having an upper lubricated friction interface and a lower lubricated friction interface, the upper lubricated friction interface comprising the bearing surface of the collar as the movable friction element and the flat washer as the stationary friction element, the lower lubricated friction interface comprising the bearing surface of the locknut as the movable friction element and the lower compliance element as the stationary friction element.

8. A tuning pin according to claim 1, the tuning pin further comprising a busing, the bushing having an inner diameter slightly greater than the diameter of the core and having an outer diameter substantially the same as the diameter of the mounting hole, the length of the bushing being approximately the same as the thickness of the panel, the bushing being inserted into the mounting hole, so that the tuning pin may be mounted onto a panel having the mounting hole larger in diameter than the core.

9. In a piano having a string plate, a tuning pin for mounting on the string plate, the string plate being of any type providing a panel for tuning pins, the panel being of substantially uniform thickness and having a substantially flat upper surface and a lower surface substantially parallel with the upper surface, the panel having a mounting hole for the tuning pin, the mounting hole passing through the panel at an angle of substantially 90 degrees to the upper surface, the tuning pin comprising:

(a) a core, said core being generally cylindrical and having a central axis and having a length equal to several times its diameter, the core comprising a threaded portion and an unthreaded portion, the threaded portion comprising external screw threads beginning near one end of the core and ending intermediate the length of the core, the unthreaded portion comprising means to attach a piano string and means to engage a tuning tool;

(b) a lubricated friction interface, said lubricated friction interface comprising a movable friction element coaxial with the core, a stationary friction element in intimate proximity with the movable friction element, and a film of lubricant material situated between said movable and said stationary friction elements, the movable friction element being arranged to rotate in synchronism with the core during tuning, the stationary friction element being arranged to remain fixed with respect to the panel during tuning, the movable a nd the stationary friction elements being adjustably compressed together when the tuning pin is operational, the lubricant material being characterized by greases and dry film lubricants;

(c) a collar, said collar being coaxial with the core and being positioned on the core and being secured to the core so as to function as an integral part of the core during tuning, the collar having a bearing surface, the bearing surface of the collar being substantially flat and being generally annular and being larger diametrally than the core and facing toward the threaded portion of the core and extending in a direction at substantially 90 degrees to the length of the core;

(d) a locknut, said locknut having internal threads complementary to the external threads of the core, the locknut having a bearing surface, the bearing surface of the locknut being substantially flat and being generally annular and being larger diametrally than the core and extending in a direction at substantially 90 degrees to the central axis of the core and facing toward the collar;

(e) a compliance element, said compliance element being assembled coaxially onto the core and being situated between the collar and the locknut, the compliance element being situated adjoining a surface of the panel when the tuning pin is operational, the compliance element being a movable friction element, the surface of the panel being a stationary friction element;

(f) so that the elements of the tuning pin may be assembled and mounted onto the panel, the mounting procedure comprising introducing the threaded portion of the core into the mounting hole, engaging the threads of the locknut with the threads of the core, and adjustable tightening the locknut.

10. A tuning pin according to claim 9 wherein the collar forms an integral part of the core, the tuning pin having an upper compliance element adjoining the bearing surface of the collar and a lower compliance element adjoining the bearing surface of the locknut, said upper and said lower compliance elements comprising spring washers assembled coaxially onto the core, said upper and said lower compliance elements being movable friction elements, the tuning pin having an upper lubricated friction interface and a lower lubricated friction interface, the upper lubricated friction interface comprising the upper compliance element as the movable friction element and the upper surface of the panel as the stationary friction element, the lower lubricated friction interface comprising the lower compliance element as the movable friction element and the lower surface of the panel as the stationary friction element.

11. A tuning pin according to claim 9 wherein the collar is formed separately from the core, the collar being assembled onto the core and being secured to the core so as to function as an integral part of the core during tuning, the tuning pin having an upper compliance element adjoining the bearing surface of the collar and a lower compliance element adjoining the bearing surface of the locknut, said upper and said lower compliance elements comprising spring washers assembled coaxially onto the core, said upper end and said lower compliance elements being movable friction elements, the tuning pin having an upper lubricated friction interface and a lower lubricated friction interface, the upper lubricated friction interface comprising the upper compliance element as the movable friction element and the upper surface of the panel as the stationary friction element, the lower lubricated friction interface comprising the lower compliance element as the movable friction element and the lower surface of the panel as the stationary friction element.

12. A tuning pin according to claim 9, the tuning pin further comprising a bushing, the bushing having a inner diameter slightly greater than the diameter of the core and having an outer diameter substantially the same as the diameter of the mounting hole, the length of the bushing being approximately the same as the thickness of the panel, the bushing being inserted into the mounting hole, so that the tuning pin may be mounted onto a panel having the mounting hole larger in diameter than the core.

13. In a piano having a string plate, a tuning pin for mounting on the string plate, the string plate being of any type providing a panel for tuning pins, the panel being of substantially uniform thickness and having a substantially flat upper surface and a lower surface substantially parallel with the upper surface, the panel having a mounting hole for the tuning pin, the mounting hole passing through the panel at an angle of substantially 90 degrees to the upper surface, the tuning pin comprising:

(a) a core, said core being generally cylindrical and having a central axis and having a length equal to several times its diameter, the core comprising a threaded portion and an unthreaded portion, the threaded portion comprising external screw threads beginning near one end of the core and ending intermediate the length of the core, the unthreaded portion comprising means to attach a piano string and means to engage a tuning tool;

(b) a lubricated friction interface, said lubricated friction interface comprising a movable friction element coaxial with the core, a stationary friction element in intimate proximity with the movable friction element, and a film of lubricant material situated between said movable and said stationary friction elements the movable friction element being arranged to rotate in synchronism with the core during tuning, the stationary friction element being arranged to remain fixed with respect to the panel during tuning, the movable and the stationary friction elements being adjustably compressed together when the tuning pin is operational, the lubricant material being characterized by greases and dry film lubricants;

(c) a collar, said collar being coaxial with the core and being positioned on the core and being secured to the core so as to function as an integral part of the core during tuning, the collar having a bearing surface, the bearing surface of the collar being substantially flat and being generally annular and being larger in diameter than the core and facing toward the threaded portion of the core and extending in a direction at substantially 90 degrees to the central axis of the core;

(d) a locknut, said locknut having internal threads complementary to the external threads of the core, the locknut having a bearing surface, the bearing surface of the locknut being substantially flat and being generally annular and being larger diametrally than the core and extending in a direction at substantially 90 degrees to the central axis of the core and facing toward the collar;

(e) a compliance element, said compliance element being assembled coaxially onto the core and being situated between the collar the the locknut, the compliance element being situated adjoining a surface of the panel when the tuning pin is operational, the compliance element being a stationary friction element;

(f) a flat washer, said flat washer being assembled coaxially onto the core and being situated adjoining the compliance element when the tuning pin is operational, the flat washer being a movable friction element;

(g) so that the elements of the tuning pin may be assembled and mounted onto the panel, the mounting procedure comprising introducing the threaded portion of the core into the mounting hole, engaging the threads of the locknut with the threads of the core, and adjustably tightening the locknut.

14. A tuning pin according to claim 1 wherein the collar is formed integrally with the core, the tuning pin having an upper flat washer, the upper flat washer being assembled coaxially onto the core and being situated adjoining the bearing surface of the collar, the upper flat washer being a movable friction element, the tuning pin having an upper compliance element adjoining the upper surface of the panel and a lower compliance element adjoining the lower surface of the panel, said upper and said lower compliance elements being spring washers assembled coaxially onto the core, said upper and said lower compliance elements being stationary friction elements, the tuning pin having a flat washer, the lower flat washer being assembled coaxially onto the core and being situated adjoining the bearing surface of the locknut, the lower flat washer being a movable friction element, said upper and said lower flat washers each being coated on one side with a film of dry film lubricant material, the tuning pin having an upper lubricated friction interface and a lower lubricated friction interface, the upper lubricated friction interface comprising the upper flat washer as the movable friction element and the upper compliance element as the stationary friction element, the lower lubricated friction interface comprising the lower flat washer as the movable friction element and the lower compliance element as the stationary friction element.

15. A tuning pin according to claim 13 wherein the collar is formed separately from the core, the collar being assembled onto the core and being secured to the core so as to function as an integral part of the core during tuning, the tuning pin having an upper flat washer, the upper flat washer being assembled coaxially onto the core and being situated adjoining the bearing surface of the collar, the upper flat washer being a movable friction element, the tuning pin having an upper compliance element adjoining the upper surface of the panel and a lower compliance element adjoining the lower surface of the panel, said upper and said lower compliance elements being spring washers assembled coaxially onto the core, said upper and said lower compliance elements being stationary friction elements, the tuning pin having a lower flat washer, the lower flat washer being assembled coaxially onto the core and being situated adjoining the bearing surface of the locknut, the lower flat washer being a movable friction element, said upper and said lower flat washers each being coated on one side with a film of dry film lubricant material, the tuning pin having an upper lubricated friction interface and a lower lubricated friction interface, the upper lubricated friction interface comprising the upper flat washer as the movable friction element and the upper compliance element as the stationary friction element, the lower lubricated friction interface comprising the lower flat washer as the movable friction element and the lower compliance elmement as the stationary friction element.

16. A tuning pin according to claim 13, the tuning pin further comprising a bushing, the bushing having an inner diameter slightly greater than the outer diameter of the core and having an outer diameter substantially the same as the diameter of the mounting hole, the length of the bushing being approximately the same as the thickness of the panel, the bushing being inserted into the mounting hole, so that the tuning pin may be mounted onto a panel having the mounting hole larger in diameter than the core.

* * * * *

UNITED STATES PATENT AND TRADEMARK OFFICE

CERTIFICATE OF CORRECTION

PATENT NO. : 4,920,847

DATED : May 1, 1990

INVENTOR(S) : Harold A. Conklin, Jr.

It is certified that error appears in the above-identified patent and that said Letters Patent is hereby corrected as shown below:

ON THE TITLE PAGE:
ABSTRACT, line 11, delete "hydrodynamic".

Col. 1, line 9, delete semi-colon after "1720" and insert colon.

Col. 1, line 27, change "Convention" to "Conventional".

Col. 1, line 28, delete comma after "(6.35 cm)" and insert a comma --,-- after "long"

Col. 1, line 33, change "hold" to "hole".

Col. 1, line 42, change "716" to "7.16".

Col. 2, line 61, insert "other" following "only".

Col. 2, line 64, change "1988" to "1888".

Col. 4, line 57, after "configured," insert "being of substantially uniform thickness and".

Col. 5, line 39, change "have" to "having".

Col. 5, line 56, change "interface" to "interfaces".

Col. 7, line 35, insert a period after "Newton-meters)".

Col. 9, line 5, change "one" to "once".

Col. 10, line 1, change "preferably" to "preferable".

Col. 10, line 32, after "of" insert "the".

Col. 10, line 43, change "SEA" to "SAE".

UNITED STATES PATENT AND TRADEMARK OFFICE

CERTIFICATE OF CORRECTION

PATENT NO. : 4,920,847

DATED : May 1, 1990

INVENTOR(S) : Harold A. Conklin, Jr.

It is certified that error appears in the above-identified patent and that said Letters Patent is hereby corrected as shown below:

Col. 11, line 2, change "A19-4/A194M-87" to "A194/A194M-87".

Col. 11, line 14, change "indicate" to "indicated".

Col. 11, line 20, after "have" insert "a".

Col. 11, line 62, insert ")" after "Newton-meter".

Col. 12, line 67, insert "to" before "screw".

Col. 13, line 10, change "have" to "having".

Col. 16, line 44, change "case" to "core".

Col. 16, line 45, change "case" to "core".

Col. 16, line 67, change "if" to "it".

Col. 17, line 4, delete ")" after "3.0".

Col.18, line 6, insert "C" before "26-28".

Col. 18, line 7, change "A19-4/A194M-87" to "A194/A194M-87".

Col. 18, line 27, change "has" to "had".

Col. 18, line 33, after "collar" delete the first "the" and insert "and".

Col. 19, line 20, change "diametrically" to "diametrally".

UNITED STATES PATENT AND TRADEMARK OFFICE

CERTIFICATE OF CORRECTION

PATENT NO. : 4,920,847

DATED : May 1, 1990

INVENTOR(S) : Harold A. Conklin, Jr.

It is certified that error appears in the above-identified patent and that said Letters Patent is hereby corrected as shown below:

Col. 20, line 24, change "and" to "the".

Col. 20, line 30, change "interace" to "interface".

Col. 20, line 47, change "and" to "the".

Col. 21, line 28, change "busing" to "bushing".

Col. 22, line 34, change "adjustable" to "adjustably".

Col. 22, line 61, delete "end".

Col. 23, line 5, change "a" (second occurrence) to "an".

Col. 23, line 39, insert "," after "elements".

Col. 24, line 16, change "1" to "13".

Col. 24, line 28, after "a" insert "lower".

Signed and Sealed this

Tenth Day of December, 1991

*Attest:*

HARRY F. MANBECK, JR.

*Attesting Officer*

*Commissioner of Patents and Trademarks*